US007699666B2

(12) United States Patent
Höhne et al.

(10) Patent No.: US 7,699,666 B2
(45) Date of Patent: Apr. 20, 2010

(54) ELECTRICAL CONTACT ARRANGEMENT HAVING A FIRST AND A SECOND CONTACT PIECE

(75) Inventors: Götz Höhne, Berlin (DE); Bernd-Heiko Krafft, Berlin (DE); Karl Mascher, Berlin (DE); Michael Punger, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 252 days.

(21) Appl. No.: 11/908,805

(22) PCT Filed: Mar. 8, 2006

(86) PCT No.: PCT/EP2006/060539

§ 371 (c)(1),
(2), (4) Date: Sep. 17, 2007

(87) PCT Pub. No.: WO2006/097420

PCT Pub. Date: Sep. 21, 2006

(65) Prior Publication Data

US 2008/0214053 A1 Sep. 4, 2008

(30) Foreign Application Priority Data

Mar. 15, 2005 (DE) ..... 10 2005 012 930

(51) Int. Cl.
*H01R 13/24* (2006.01)

(52) U.S. Cl. ..... 439/700

(58) Field of Classification Search ..... 439/700, 439/824

See application file for complete search history.

(56) References Cited

U.S. PATENT DOCUMENTS

| | | | | |
|---|---|---|---|---|
| 1,970,587 | A | 8/1934 | Werner | |
| 3,727,173 | A | 4/1973 | Goldmann et al. | |
| 3,970,355 | A | 7/1976 | Pitschi | |
| 4,205,209 | A | 5/1980 | Thuries et al. | |
| 4,973,806 | A | 11/1990 | Kirchesch et al. | |
| 5,358,418 | A * | 10/1994 | Carmichael | 439/190 |
| 6,149,467 | A | 11/2000 | Choy | |
| 6,184,698 | B1 | 2/2001 | Yoshida et al. | |
| 6,259,050 | B1 | 7/2001 | Zehnder et al. | |
| 7,094,112 | B2 * | 8/2006 | Arai et al. | 439/700 |

FOREIGN PATENT DOCUMENTS

| | | |
|---|---|---|
| CN | 1032882 A | 5/1989 |
| CN | 1263633 A | 8/2000 |
| DE | 372774 | 4/1923 |
| DE | 1 127 977 | 4/1962 |
| DE | 1 916 468 | 10/1970 |
| DE | 2 324 552 | 12/1974 |
| DE | 28 33 624 | 3/1979 |

(Continued)

*Primary Examiner*—Javaid Nasri
(74) *Attorney, Agent, or Firm*—Laurence A. Greenberg; Werner H. Stemer; Ralph E. Locher

(57) ABSTRACT

A first contact piece and a second contact piece interact to give a contact configuration. The second contact piece is singled-sided and can be reversibly deformed. In order to increase the contact pressure of the second contact piece onto the first contact piece, an additional pressure element is provided. The pressure element generates contact pressure acting upon the second contact piece via a deflecting device.

12 Claims, 3 Drawing Sheets

FOREIGN PATENT DOCUMENTS

| | | | |
|---|---|---|---|
| DE | 36 24 636 | A1 | 1/1988 |
| DE | 40 18 947 | A1 | 1/1992 |
| DE | 37 50 064 | T2 | 9/1994 |
| DE | 198 16 508 | | 10/1999 |
| DE | 199 31 337 | | 1/2000 |
| EP | 0 260 132 | B1 | 3/1988 |
| EP | 0313813 | A1 | 5/1989 |
| FR | 1.393.232 | | 3/1965 |
| FR | 2 493 031 | | 4/1982 |
| FR | 2 748 863 | | 11/1997 |
| GB | 1 577 850 | | 10/1980 |
| WO | WO 9953512 | A1 | 10/1999 |

* cited by examiner

ELECTRICAL CONTACT ARRANGEMENT HAVING A FIRST AND A SECOND CONTACT PIECE

BACKGROUND OF THE INVENTION

Field of the Invention

The invention relates to an electrical contact arrangement having a first contact piece and a second sprung contact piece which is clamped in at a first end and its second end rests in a sprung manner on the first contact piece. The invention also relates to an electrical contact arrangement having a first contact piece and a second contact piece, which is pressed against the first contact piece by means of a contact-pressure element.

It is known, for example, for plug contact arrangements to be formed from a contact piece in the form of a bolt and a contact piece in the form of a socket. The contact piece in the form of a socket is in this case, for example, formed from sprung contact fingers which are elastically deformed during insertion of the contact piece in the form of a bulb, and ensure that electrical contact is made.

The relative movement of the contact pieces of the electrical contact arrangement, and the friction which results in this case at the contact-making points, results in material wear. The material wear results in a decrease in the contact-pressure force in the contact-making area over the course of time. After a multiplicity of contact operations, the contact arrangement exhibits not inconsiderable wear, so that it must be replaced.

SUMMARY OF THE INVENTION

The invention is therefore based on the object of designing an electrical contact arrangement of the type mentioned initially such that a lengthened useful life of the contact arrangement is made possible. A further object of the invention is to design an electrical contact arrangement of the type mentioned initially such that this results in a physically small, compact arrangement.

In the case of an electrical contact arrangement having a first contact piece and a second sprung contact piece, which is clamped in at a first end and its second end rests in a sprung manner on the first contact piece, the object is achieved according to the invention in that a contact-pressure element presses the second end against the first contact piece.

Since the sprung second contact piece is still clamped in at one end, the elasticity of the second sprung contact piece can be made use of to produce a portion of the contact-pressure force for pressing the second contact piece against the first contact piece. Furthermore, by being clamped in at one end, an electrical contact can be made with the second contact piece, for inclusion in a current path. This reduces the number of contact junctions, thus restricting the increase in resistance caused by the electrical contact arrangement. Furthermore, the use of a contact-pressure element makes it possible to use materials for the second contact piece which can themselves be deformed elastically, but which cannot apply sufficient contact pressure on their own. The choice of a suitable contact-pressure element from a range of contact-pressure elements with different force profiles makes it possible to adapt the contact-pressure forces depending on the field of operation of the electrical contact arrangement. Furthermore, the use of a contact-pressure element provides the capability to apply comparatively high contact forces to the second contact piece without requiring major sprung deformation of the contact piece. In previous applications, it was often necessary to pivot the sprung contact piece well into the area required by the first contact piece after contact was made, in order to produce major deflection of the second contact piece. A corresponding contact force could be produced by the large deflection. Such major elastic deformation of the second contact piece results in comparatively rapid ageing of the contact arrangement, since the major deformation causes material fatigue. The use of a contact-pressure element means that there is no longer any need for such major deformation of the second contact piece. When a high contact force is required for the second contact piece, an appropriately powerful contact-pressure element can be chosen. The separate contact-pressure element increases the contact force without having to increase the mechanical bending stress on the elastically sprung contact element. In addition, the contact arrangement adjusts itself automatically when wear occurs.

One advantageous refinement of the invention can be provided in this case by the spring element being a leaf spring.

The use of a spring element allows the contact force of the second sprung contact piece to be influenced in a simple manner. For example, the spring element can be held in an opposing bearing and can be pressed against the second sprung contact piece so that it rests on the first contact piece. The use of a spring element as the contact-pressure element results in the spring constants of the second sprung contact piece and the spring constant of the spring element being superimposed. This allows the force profile of the two coupled components to be optimized. It is therefore possible, for example, to provide for an approximately virtually constant contact force to be produced irrespective of the deflection of the second sprung contact piece.

It is advantageously also possible to provide for the spring element to be a leaf spring.

Leaf springs can be produced in large quantities at low cost from an appropriate spring steel, by stamping processes. Leaf springs which act in different ways can therefore be produced with appropriate shaping. For example, it is possible to provide for the leaf spring to be clamped in at both ends and to produce a spring effect in this case by virtue of curvature of the spring leaf. It is also possible to provide for the leaf spring to be mounted at only end, and for the other end to rest in a sprung manner against the second sprung contact piece. In this case, it is advantageous for the leaf spring to extend along the longitudinal axis of the second contact piece. For example, the second contact piece may have one or more contact fingers, with respect to which the leaf spring or springs is or are aligned essentially parallel.

A further advantageous refinement makes it possible to provide for the spring element to be a helical spring.

Helical springs are able to produce high contact forces with comparatively little axial expansion. Even minor deflections of the second sprung contact piece can thus produce a high contact force from the second sprung contact piece on the first contact piece. In this case, it is possible to provide for the helical spring to be supported on a stationary chassis and to be pressed against the second sprung contact piece. Deflection of the second sprung contact piece when making contact with the first contact piece thus results in compression of the helical spring. Furthermore, however, it is also possible to provide for a long helical spring to cover, for example, a multiplicity of contact fingers arranged in an annular shape with respect to one another. In this case, there is no need for an outer chassis to support the helical spring. In fact, expansion of the helical spring leads to radial compression of the individual contact fingers. The spring force acts directly on the second contact piece. However, it is also possible to provide for the spring force to be deflected, for example by means of a transmission.

It is advantageously also possible to provide for the second contact piece to be a tulip contact piece.

A tulip contact piece has a multiplicity of elastic contact fingers which are arranged radially around an axis. This results in a bush into which, for example, a first contact piece in the form of a bolt can be inserted. During insertion of the first contact piece, contact fingers are spread, thus resulting in the necessary contact force being produced. The individual contact fingers of the tulip contact piece are in this case clamped in at one end, while they oscillate freely at their other end. In consequence, the contact fingers act like a leaf spring clamped in at one end, in terms of their elastic deformability.

A further advantageous refinement makes it possible to provide for the electrical contact arrangement to be a sliding contact arrangement.

Sliding contact arrangements are contact arrangements in which the two contact pieces make electrical contact with one another all the time. However, relative movement is possible between the two contact pieces, with the electrical contact being maintained all the time. The contact areas of the two contact pieces in this case slide on one another and have to ensure that electrical contact is made all the time. The use of a contact-pressure element for a sliding contact arrangement makes it possible to prevent premature ageing caused by material fatigue.

A further object of the invention is to specify a refinement which is as compact as possible for a long-life electrical contact arrangement which is virtually free of fatigue and has a first contact piece and a second contact piece, with the two contact pieces being pressed against one another by means of a contact-pressure element.

A compact refinement variant for one solution according to the invention achieves the object, in the case of an electro-contact arrangement of the type mentioned above, of a contact force, which is produced by the contact-pressure element acting on the second contact piece via a deflection device.

A deflection device makes it possible to make more effective use of the physical space for example on an electrical switch. For example, this means that it is possible to arrange the contact-pressure element within an unused area, and to introduce the contact force into the desired area via a deflection device. The deflection device provides the capability to choose the most suitable contact-pressure element and to arrange this in a position which is optimized for its method of operation. For example, this means that it is possible to use contact-pressure elements which are dependent on the force of gravity, and to deflect the force effect in other directions, irrespective of their installed position. For example, this means that it is possible for mass elements which are attracted by the force from the earth to develop their force effect in the opposite direction, via rockers or levers.

It is advantageously possible to provide for the deflection device to deflect the force flow through more than 45°, in particular through about 90°.

Industrial structures are preferably produced using right angles (90° angles) in order to make it possible to work with a multiplicity of standardized modules. It is thus possible to arrange the deflection devices such that the force flow is preferably deflected through 90°. In this case, by way of example, a flexible Bowden cable can be used as the deflection device, thus allowing the force flow to be laid and guided highly flexibly. It is also possible to provide for hydraulic arrangements to be used as deflection devices, and for the force flow to be deflected or else distributed in this way.

A further advantageous refinement makes it possible to provide for the deflection device to have a first and a second deflection element, which touch one another on movement surfaces.

The use of two deflection elements which touch one another on movement surfaces allows a deflection device to be designed to be physically very simple. Furthermore, an arrangement such as this can be used to deflect large forces in a confined space. For example, it is possible to provide for one of the two deflection elements or for both deflection elements to have surfaces which rest on one another in the form of a wedge, with the force flow being deflected when the surfaces are moved with respect to one another. In order to deflect the force flow such that it is distributed as uniformly as possible, the two surfaces may each be arranged in the form of a wedge with respect to one another, with the wedge angle in each case being formed in opposite senses. Alternatively, however, it is also possible to provide for only one of the two deflection elements to be provided with a wedge-shaped movement surface, on which any desired body edge/body surface of the other deflection element rests. This allows a simple design configuration of the deflection device.

In this case, it is also advantageously possible to provide for one of the deflection elements to be a sleeve or at least a segment of a sleeve.

By way of example, a sleeve is created in the form of a hollow cylinder, in which case the sleeve can also be formed conically. If it is conical, this provides the capability for the sleeve to move for example onto/into a sleeve section which is formed from a plurality of segments, with the sleeve segments being driven apart from one another or being compressed, as a result of the conical shape.

It is advantageously also possible to provide for the first contact piece to be an arcing contact piece of a high-voltage circuit breaker.

High-voltage circuit breakers are switching devices which have to carry out switching operations reliably over several decades. The contact elements that are used are in this case subject to relatively stringent requirements. In particular, the arcing contact pieces which are used in high-voltage circuit breakers are subject to increased wear. Increased demands are therefore placed on the electrical contact arrangements used there.

Provision can advantageously be made in this case for the first contact piece to be an arcing contact piece.

This arcing contact piece may, for example, be in the form of a bolt, in which case the second contact piece extends around the first contact piece in the form of a bush, and the contact areas are located on the outer surface of the first contact piece, which is in the form of a bolt.

A further advantageous refinement makes it possible to provide for the first contact piece to be movable by means of a transmission along a first axis.

If the first contact piece can move along a first axis, this makes it possible to produce a positive disconnection response or connection response for a high-voltage circuit breaker. The contact disconnection speed can additionally be influenced by the transmission. In general, it is advantageous in this case for the transmission to provide an increase in the contact disconnection speed, so that a disconnection point is produced quickly in the high-voltage circuit breaker, thus allowing the high-voltage circuit breaker to be switched with as little risk as possible of the restriking and arcing.

One advantageous refinement makes it possible to provide in this case for a transmission element for the transmission to be a dielectric nozzle.

In a high-voltage circuit breaker, a dielectric nozzle is used to quickly remove the switching gases that occur during a switching process, that is to say the switching gases and combustion products which have been overheated by the arc, from the switching gap. A dielectric nozzle makes it possible to produce a particular flow in the area of the switching gap, thus allowing the switching gas to be cleared of contamination products quickly. In order to avoid a negative influence on the dielectric strength of the switching gap, the dielectric nozzle is formed from a dielectric, for example polytetrafluoroethylene. Because of the high thermal load, the dielectric nozzle is provided with an appropriate wall thickness. This makes it sufficiently mechanically robust in order to use it as a transmission element for the transmission.

It is advantageously also possible to provide for the second contact piece to be a tulip contact piece, which is arranged coaxially with respect to the first axis.

A tulip contact piece has a multiplicity of contact fingers, which are arranged distributed radially around an axis. The contact fingers are in this case held at one end, so that they can be deformed elastically to a certain extent in the form of a leaf spring.

Furthermore, it is advantageously possible to provide for the contact-pressure element to be a helical spring, or for the contact-pressure element to be a leaf spring.

Helical springs and leaf springs can produce large contact forces in a small physical area. In this case, helical springs and leaf springs are available in large quantities at low cost. Furthermore, it is advantageously possible to provide for the second contact element to be surrounded by a cover which has a sliding bearing in which the first contact piece is guided.

By way of example, a cover may be in the form of a closed sleeve, such that contact-pressure elements or contact pieces which are arranged in the interior are protected against external influences, for example the thermal effects of arcs, flowing switching gases or the like. In addition, the cover can be used to guide the first contact piece. Particularly when the first contact piece is in the form of a bolt, for example, an annular sliding bearing can be used in order to guide the movement of the first contact piece. By way of example, the sliding bearing may be formed from an electrically conductive structure, for example a metallic needle bearing or else an electrically insulating bush. The electrically insulating bush is, for example, formed from polytetrafluoroethylene, and is inserted in the cover.

Exemplary embodiments of the invention will be described in more detail in the following text and are illustrated schematically in the figures in which:

DESCRIPTION OF THE INVENTION

Figure 1:
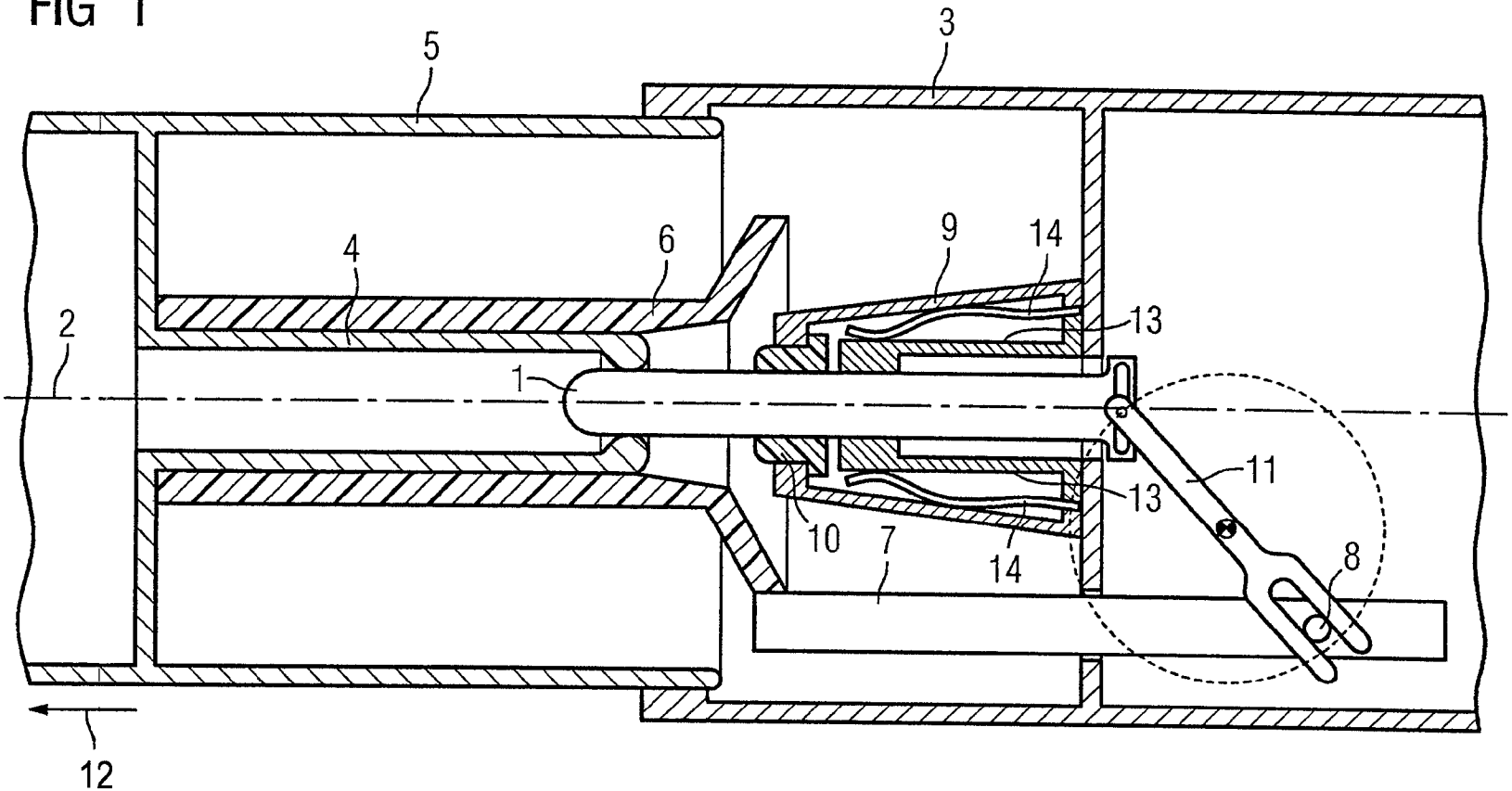
FIG. 1 shows a section through a schematically illustrated high-voltage circuit breaker.

The high-voltage circuit breaker illustrated in the form of a section in FIG. 1 has a first contact piece 1. The first contact piece 1 acts as an arcing contact piece in the form of a bolt. The first contact piece 1 is arranged coaxially with respect to a first axis 2 of the high-voltage circuit breaker. The first contact piece 1 is surrounded by a first rated current contact piece 3. The first rated current contact piece 3 is likewise arranged coaxially with respect to the first axis 2. An arcing contact piece 4 in the form of a bush is arranged opposite this, along the first axis 2. The arcing contact piece 4, which is in the form of a bush, is arranged coaxially with respect to the first axis 2. The arcing contact piece 4, which is in the form of a bush, is surrounded by a second rated current contact piece 5. The first rated current contact piece 3 and the second rated contact piece 5 can be moved relative to one another along the first axis 2, such that the high-voltage circuit breaker, which is illustrated in its connected position in FIG. 1, can be moved to a disconnected position. The arcing contact piece 4, which is in the form of a bush, is connected at a rigid angle to the second rated current contact piece 5. The free end of the arcing contact piece 4, which is in the form of a bush, is surrounded by a dielectric nozzle 6. The dielectric nozzle 6 is used to guide the quenching gases which are created during a disconnection process in the interior of the high-voltage circuit breaker. These quenching gases are, for example, thermally heated insulating gases (for example sulfurhexachloride, nitrogen), or else plasma clouds caused by the combustion of metals and dielectrics. The rated current contact pieces 3, 5 and the first contact piece 1 as well as the arcing contact piece 4, which is in the form of a bush, are in this case arranged with respect to one another such that, during a disconnection process, the rated current contact pieces 3, 5 are first of all disconnected from one another, followed by the arcing contact pieces 3, which are in the form of bushes, and the first contact piece 1. This ensures that any disconnection arc that occurs is struck between the arcing contact piece 4, which is in the form of a bush, and the first contact piece 1. This protects the rated current contact pieces 3, 5 against thermal arc loads. The opposite switching sequence occurs during a connection process, that is to say contact is made between the arcing contact piece 4, which is in the form of a bush, and the first contact piece 1 before contact is made in the rated current contact pieces 3, 5. This ensures that any prearcing that may occur does not occur on the rated current contact pieces 3, 5. This constellation protects the rated current contact pieces 3, 5 against switching arcs caused by contact erosion during both connection and disconnection processes.

In order to thermally load the arcing contact piece 4, which is in the form of a bush and is subject to the direct influence of arcs, and the first contact piece 1 as lightly as possible as well, the first contact piece 1 is additionally driven. A driver lever 7 is coupled to a dielectric nozzle 6 for this purpose. A driver bolt 8, which is arranged transversely with respect to the direction of the first axis 2 is attached to the driver lever 7. A cover 9 is attached to the first rated current contact piece 3. The cover 9 has a sliding bearing 10. The first contact piece 1 is mounted in the sliding bearing 10 such that it can move along the first axis 2. The sliding bearing 10 is formed from a dielectric bush. At its end remote from the switching point, the first contact piece 1 has an elongated hole in which a first end of a two-armed lever 11 engages. The two-armed lever 11 is mounted on the first rated current contact piece 3 such that it can rotate. The second end of the two-armed lever 11 has an opening in the form of a fork in which the driver bolt 8 of the driver lever 7 engages.

Starting with the high-voltage circuit breaker in the connected state illustrated in FIG. 1, the second rated contact piece 5 and the arcing contact piece 4, which is in the form of a bush, are moved in the direction of the arrow 12. This movement results in the dielectric nozzle 6 and the driver lever 7 that is attached to the dielectric nozzle 6 also being moved. The driver bolt 8, which is attached to the driver lever 7, results in the two-armed lever 11 rotating in the clockwise sense, so that the first contact piece 1 is moved in the opposite direction to the arrow 12. This results in an increase in the disconnection speed of the first contact piece 1 from the arcing contact piece 4, which is in the form of a bush.

A contact arrangement is provided in order to make electrical contact with the arcing contact piece 1, which can move relative to the first rated contact piece 3. The contact arrangement is arranged essentially in the interior of the cover 9. A second contact piece 13 is arranged radially around the first contact piece 1. The second contact piece 13 has a multiplicity of contact fingers which are distributed uniformly around the circumference of the outer surface of the first contact piece 1. The contact fingers are contact elements and thus form a tulip contact piece. The contact fingers themselves are resiliently elastic and are held at one end, at their end remote from the contact area. The contact fingers rest on the outer surface of the first contact piece 1 in their contact area. Spring elements are arranged in the interior of the cover 9 in order to assist the contact force of the contact fingers, which are deflected in a resiliently elastic form, of the second contact piece 13. The spring elements are in the form of leaf springs 14. The leaf springs 14 are in this case held at one end in the area of the foot points of the contact fingers of the second contact piece 13, where they are shaped such that they rest in places on the inner wall of the cover 9, so that their free ends are pressed against the contact fingers of the second contact piece 13, thus increasing the contact force. Alternatively, it is also possible to use further leaf-spring shapes. The leaf springs can thus each be clamped in at their ends and may have a curved deflection, thus resulting in a spring curve.

The second contact piece 13 and the leaf springs 14 are well protected against thermal and mechanical influences in the interior of the cover.

Figure 2:
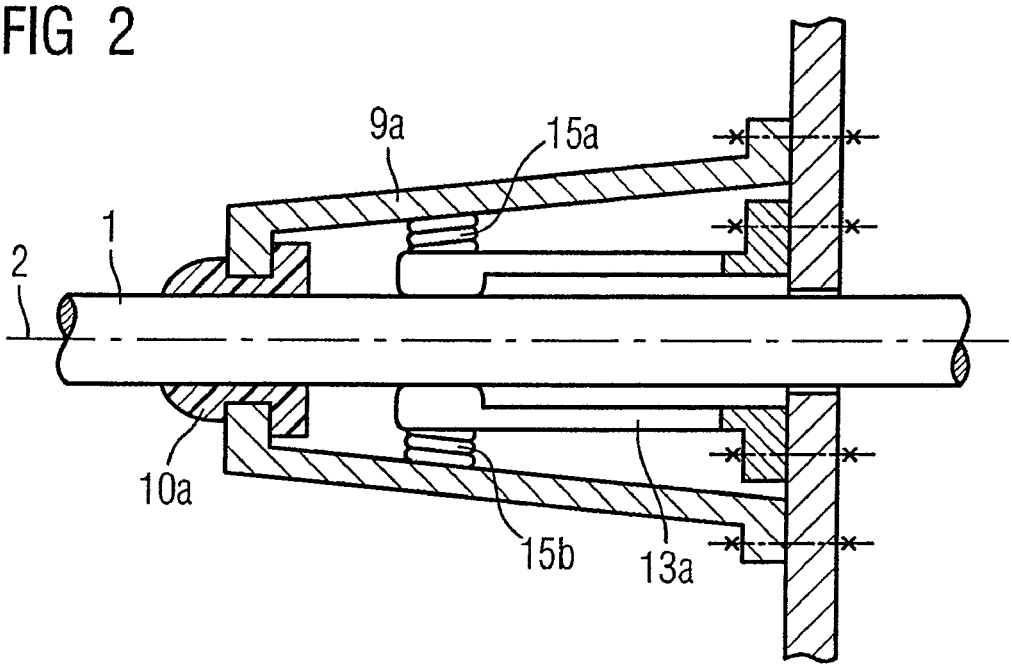
FIG. 2 shows a second embodiment of a contact arrangement.

FIG. 2 shows a second embodiment variant of a contact arrangement. The first contact piece 1 is once again guided in a sliding bearing 10*a*, which is inserted adjacent to a cover 9*a*. The second contact piece 13*a* is once again formed from a multiplicity of contact fingers which are distributed around the outer surface of the first contact piece 1. In the present case, helical springs 15*a*, 15*b* are used to increase the contact force of the elastically deformable contact fingers of the second contact piece 13*a*. In this case, a plurality of the helical springs are arranged distributed around the circumference and aligned radially with respect to the first axis 2, such that the contact fingers of the second contact piece 13*a* are pressed against the outer surface of the first contact piece in the radial direction. In this case, it is advantageously possible to provide for each of the contact fingers to have a separate associated contact-pressure element.

Figure 3:
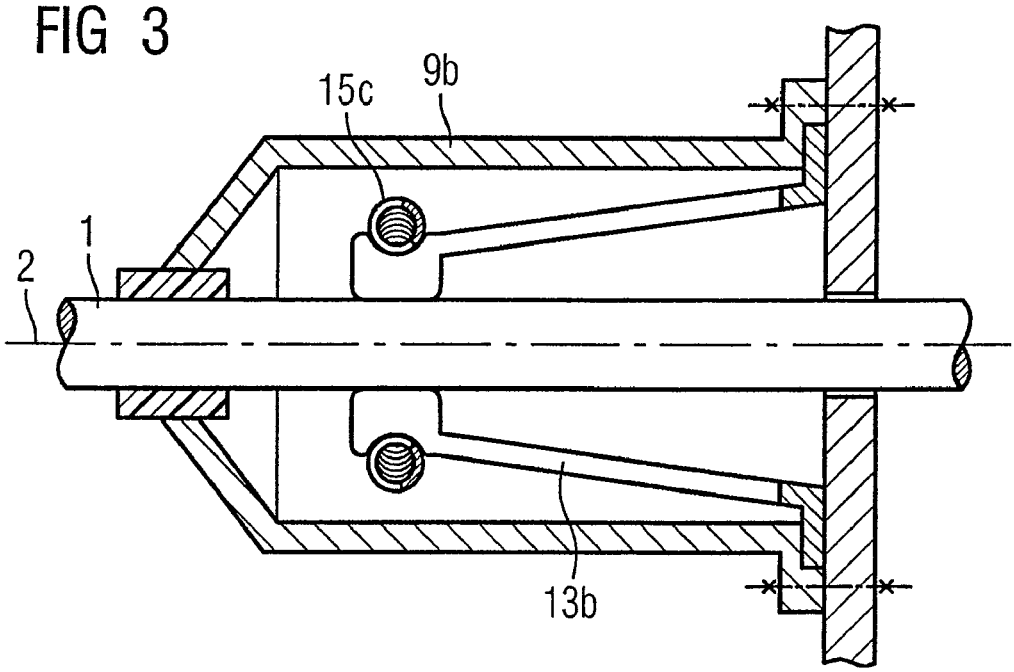
FIG. 3 shows a third embodiment of a contact arrangement.

FIG. 3 shows a third embodiment variant of a contact arrangement with a first contact piece 1 and a second contact piece 13*b*. The second contact piece 13*b* is once again in the form of a tulip contact, with the individual contact fingers having a depression on the outer circumference in the area of their contact surfaces. A single helical spring 15*c* is inserted in the depression. The helical spring 15*c* has a turn axis which is curved in the form of a circle and is aligned coaxially with respect to the first axis 2. The helical spring 15*c* therefore forms an elastic ring, which presses the contact fingers of the second contact piece 13*b* in the radial direction with respect to the first axis 2 against the outer surface of the first contact piece 1. This configuration has the advantage that there is no need for any additional support on the cover 9*b*.

Figure 4:
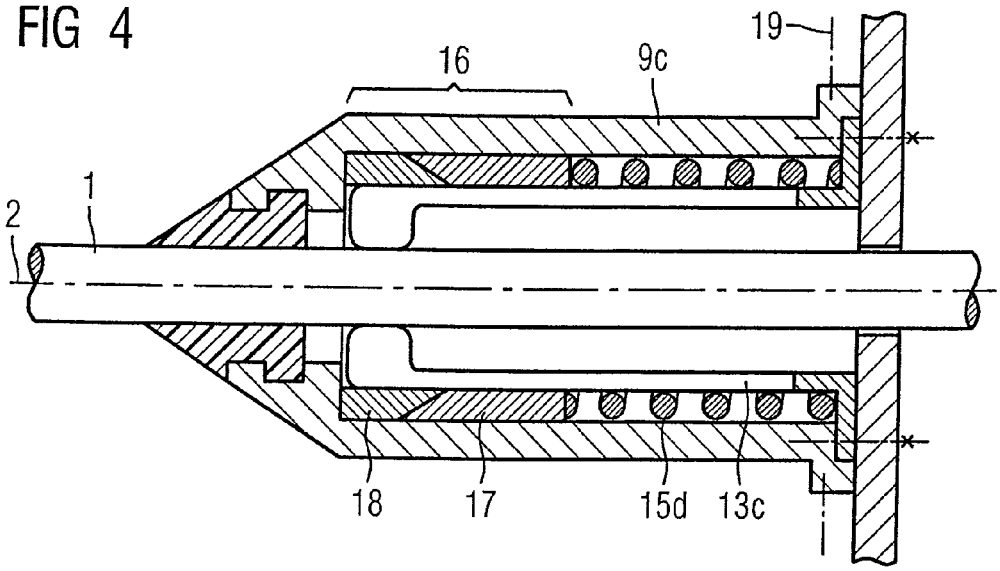
FIG. 4 shows a fourth embodiment of a contact arrangement.

FIG. 4 shows a further, particularly compact, variant of a contact arrangement. Once again, a second contact piece 13*c* is arranged in the interior of the cover 9*c*, with the second contact piece 13*c* once again having a multiplicity of contact fingers which are arranged distributed radially around the circumference of the first contact piece 1. The second contact piece 13*c* is surrounded by a cover 9*c*, coaxially with respect to the first axis 2. A helical spring 15*d* is arranged between this and the contact fingers. The cover 9*c* is in this case designed such that the helical spring 15*d* is guided with a clearance fit between the inner wall of the cover 9*c* and the outer surface of the second contact piece 13*c*. The contact force of the helical spring 15*c* in this case acts in the direction of the first axis 2. A deflection device 16 is provided in order to deflect the contact force of the helical spring 15*d* in the radial direction. The deflection device 16 has a first deflection element 17 and a second deflection element 18. The first deflection element 17 is in the form of a sleeve which fills the space formed between the cover 9*c* and the second contact piece 13*c*. The sleeve is arranged coaxially with respect to the first axis 2. At its sleeve opening facing the second deflection element 18, its internal diameter is widened conically outwards. This results in a conical movement surface. The second deflection element is formed from three sleeve segments (see FIG. 5) which are arranged coaxially with respect to the first axis 2. On their side facing the first deflection element 17, the sleeve segments have a conically tapering, decreasing circumference. The conical taper results in a wedge-shaped movement surface. The second deflection element 18 abuts against a shoulder on the cover 9*c* on the side remote from the first deflection elements 17.

The helical spring 15*d* is supported at the foot point of the second contact piece 13*c*, and presses the first deflection element 17 in the direction of the free ends of the contact fingers of the second contact piece 13*c*. Since the movement surfaces of the two deflection elements 17, 18 are wedge-shaped in opposite directions, and the second deflection element 18 is in the form of segments, the segments of the second deflection element 18 are pressed in the radial direction onto the contact fingers of the second contact piece 13*c*. This increases the contact force of the contact arrangement. In addition to the second contact piece 13*c* being clamped in at one end as shown in FIG. 4, it is also possible to use deflection elements 17, 18 at both ends of the helical spring 15*d*. This makes it possible to provide a "floating" second contact piece 13*c*, each of whose free ends are pressed in the radial direction against the first contact piece 1, within a cover, via deflection elements.

A design such as this can be produced, for example, by a mirror image along the axis 19 of the arrangement shown in the figure. In this case, the helical spring 15*d* is pressed in between two deflection devices, which are respectively located at the ends of the helical spring 15*d*, where they rest on shoulders on the cover 9*c*.

Figure 5:
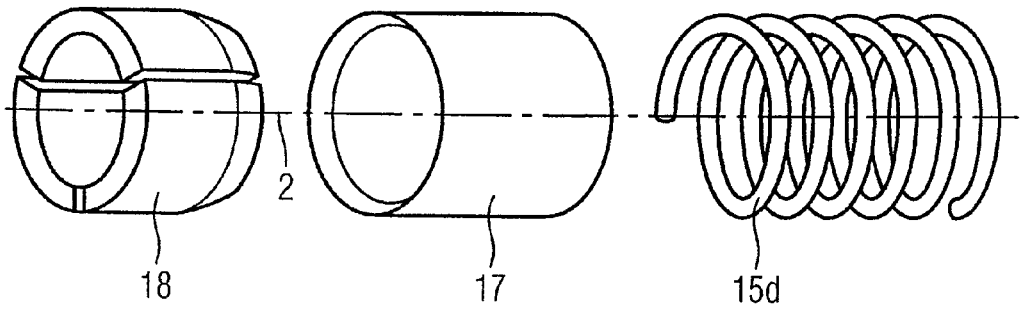
FIG. 5 shows a detail from FIG. 4.

FIG. 5 illustrates an exploded view of the first deflection element 17 and the second deflection element 18. This shows the movement surfaces, which are in each case arranged in the form of wedges with respect to one another, of the deflection elements 17, 18 as well as the segment structure of the second deflection element 18.

Figure 6:
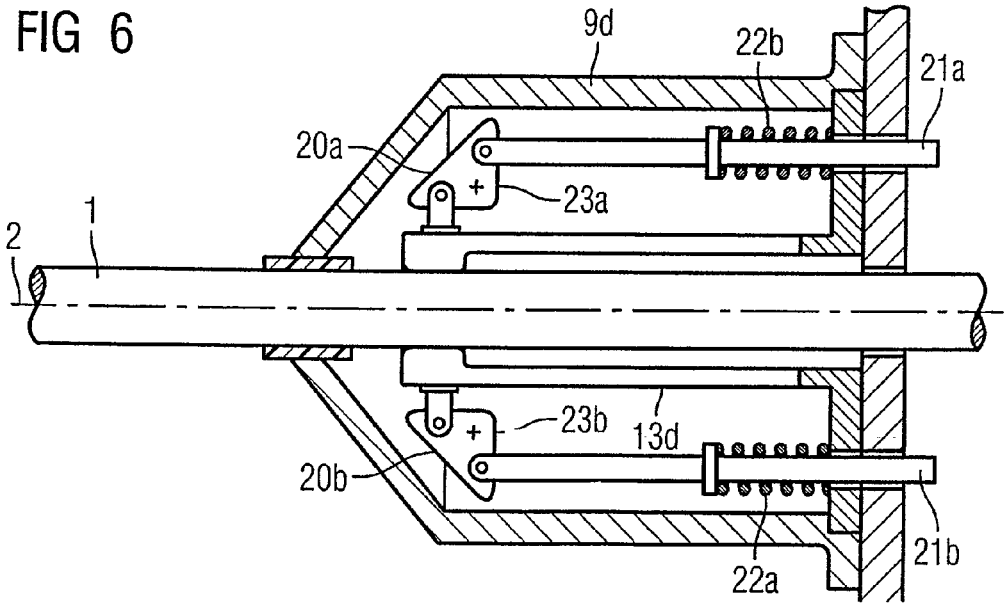
FIG. 6 shows a fifth embodiment of a contact arrangement.

FIG. 6 shows a further contact arrangement which uses one deflection device to deflect the force flow originating from a contact-pressure element. Once again, a second contact piece 13*d* is arranged in the interior of a cover 9*d*. The second contact piece 13*d* has a multiplicity of contact elements which are clamped in at one end. Deflection devices 20*a*, 20*b* are provided in order to press the free ends of the contact elements, which act as the contact finger, onto the outer surface of the first contact piece 1. The deflection devices are in this case designed such that they are each associated with one individual contact finger or a group of contact fingers. The deflection devices each have a connecting rod 21*a*, 21*b*. The connecting rods are provided with stops, on which the helical springs 22*a*, 22*b* are supported. The helical springs 22*a*, 22*b* are supported at one of their ends on the stops of the connecting rods 21*a*, 21*b*. At their other ends, the helical springs 22*a*, 22*b* are supported at the attachment point of the second contact piece 13*d*. These arrangements result in the connecting rods 21*a*, 21*b* being moved in a spring-loaded form essentially parallel to the first axis 2. The force flow originating from the helical springs 22*a*, 22*b* is deflected through 90° by a respective third deflection element 23*a*, 23*b*. The third deflection elements 23*a*, 23*b* are each in the form of angled levers, and are mounted in fixed positions. The free ends of the contact fingers of the second contact piece 13*g* are pressed onto the outer surface of the first contact piece 1 via the angled levers 23*a*, 23*b*.

The configurations of the contact arrangements illustrated in the figures can be combined with one another, that is to say the differently designed sliding bearings 10 or else, for example, the differently designed covers 9, 9*a*, 9*b*, 9*c*, 9*d*, the differently designed second contact pieces 13, 13*a*, 13*b*, 13*c*, 13*d*, etc., can be interchanged with one another, thus making it possible to form further embodiments from the combinations of the contact arrangements illustrated in the figures.

The invention claimed is:

1. An electrical contact configuration, comprising:

a first contact piece defining a first axis through the length thereof;

a deflection device;

a contact-pressure element applying a force in a direction of the first axis; and a second contact piece pressed against said first contact piece by said contact-pressure element, said contact-pressure element producing a contact force acting on said second contact piece to press a portion of said second contact piece in a radial direction against said first contact piece via said deflection device.

2. The electrical contact configuration according to claim 1, wherein said deflection device deflects a force flow through more than 45°.

3. The electrical contact configuration according to claim 1, wherein said deflection device includes a first deflection element including a first movement surface and a second deflection element including a second movement surface, said first deflection element and said second deflection element touching one another at said first movement surface and said second movement surface.

4. The electrical contact configuration according to claim 3, wherein one of said first and second deflection elements is selected from the group consisting of a sleeve and at least a segment of a sleeve.

5. The electrical contact configuration according to claim 1, wherein said first contact piece is an arcing contact piece of a high-voltage circuit breaker.

6. The electrical contact configuration according to claim 1, wherein said contact-pressure element is a spring element.

7. The electrical contact configuration according to claim 6, wherein said contact-pressure element is at least one of a leaf spring and a helical spring.

8. The electrical contact configuration according to claim 1, wherein said deflection device deflects a force flow through more than 90°.

9. The electrical contact configuration according to claim 1, wherein said deflection device includes first and second deflection elements, the first deflection element being sleeve-shaped.

10. The electrical contact configuration according to claim 9, wherein the first deflection element is pressed over the second contact piece to apply a radial force on said second contact piece.

11. The electrical contact configuration according to claim 10, wherein the first deflection element is pressed over the second contact piece using a conical feed surface of the first deflection element.

12. The electrical contact configuration according to claim 11 wherein the second deflection element is formed from a plurality of sleeve segments arranged coaxially with respect to the first axis.

* * * * *